US012636697B2

(12) United States Patent
Manterys et al.

(10) Patent No.: US 12,636,697 B2
(45) Date of Patent: May 26, 2026

(54) APPARATUS AND METHOD FOR TWISTING WIRES

(71) Applicant: Aptiv Manufacturing Management Services GmbH, Schaffhausen (CH)

(72) Inventors: Marek Manterys, Cracow (PL); Kamil Kilian, Cracow (PL)

(73) Assignee: Aptiv Manufacturing Management Services GmbH, Schaffhausen (CH)

( * ) Notice: Subject to any disclaimer, the term of this patent is extended or adjusted under 35 U.S.C. 154(b) by 350 days.

(21) Appl. No.: 18/098,436

(22) Filed: Jan. 18, 2023

(65) Prior Publication Data

US 2023/0241665 A1 Aug. 3, 2023

(30) Foreign Application Priority Data

Jan. 28, 2022 (EP) ..... 22153936

(51) Int. Cl.
*B21F 15/04* (2006.01)

(52) U.S. Cl.
CPC ..... *B21F 15/04* (2013.01)

(58) Field of Classification Search
CPC . B21F 7/00; B21F 9/002; B21F 15/04; H01B 13/0207; H01B 13/0235; H01B 7/0045
USPC ..... 72/299
See application file for complete search history.

(56) References Cited

U.S. PATENT DOCUMENTS 2,457,132 A * 12/1948 Delaney ..... B21H 3/00 72/203
3,052,079 A * 9/1962 Henning ..... D07B 3/005 174/34
3,421,351 A * 1/1969 Doran ..... B21D 11/14 72/64
3,750,720 A * 8/1973 Steigerwald ..... B21F 7/00 72/299
4,467,596 A * 8/1984 Feese ..... H01B 13/0235 57/293
4,770,016 A * 9/1988 Stepanenko ..... B21F 1/02 72/64
6,167,919 B1 * 1/2001 Fuchsl ..... H01B 13/0207 140/149
2005/0022572 A1 * 2/2005 Kato ..... B21F 7/00 72/299

(Continued)

FOREIGN PATENT DOCUMENTS

DE 2812208 A1 10/1979
DE 102017002939 B3 7/2018
DE 102018209728 A1 12/2019

OTHER PUBLICATIONS

Translation De 2812208A1, Kabel Metallwerke, Oct. 1979.*

(Continued)

*Primary Examiner* — Edward T Tolan
(74) *Attorney, Agent, or Firm* — Billion & Armitage

(57) ABSTRACT

An apparatus for twisting an elongate element such as a wire or cable, includes a) a first holder configured to hold a first portion of the element; b) a second holder configured to hold a second portion of the element; c) a twisting unit configured to twist the element at a third portion between the first and the second portion. The twisting unit and the second holder are configured to be movable relative to the first holder in the same direction.

16 Claims, 3 Drawing Sheets

(56) References Cited

U.S. PATENT DOCUMENTS

2021/0020337 A1 1/2021 Ciapala et al.

OTHER PUBLICATIONS

DE 102018209728A1, Proschel et al. Dec. 2019.*
Translation DE 102018209728A1, Proschel et al. Dec. 2019.*
Extended European Search Report for Application No. 22153936.4, mailed on Jul. 19, 2022, 8 pages.

* cited by examiner

APPARATUS AND METHOD FOR TWISTING WIRES

CROSS-REFERENCE TO RELATED APPLICATION

This application claims benefit of priority to European Patent Application No. 22153936.4 filed on Jan. 28, 2022, the entire disclosure of which is hereby incorporated by reference.

TECHNICAL FIELD OF THE INVENTION

The present invention relates to an apparatus and a method for twisting an element, in particular a wire or multiple wires.

BACKGROUND

Due to the ongoing industrialization and automatization, more cables, wires, or the like are required to facilitate communicating connections among various parts, e.g., to electrically connect various parts. For this communication, wires or part of wires or pairs of wires are typically twisted, which improves the connection among various parts. For instance, twisting helps to alleviate exterior electromagnetic interferences, which improves electromagnetic compatibility.

Ongoing production process automatization strategies demand for an automatization to produce twisted wires. This can be done for instance on central twisting machines.

Central twisting machines are known and typically include a securing mechanism configured to secure ends of the wires, e.g., a first and a second wire to be twisted. The first wire is arranged parallel to the second wire along a longitudinal axis. The machine also includes a gripping mechanism to grip central portions of the first and second wires such that inner surfaces of the central portions of the first and second wires are in contact with one another, and a rotating mechanism configured to rotate the gripping mechanism, thereby twisting the first and second wires about one another.

This poses a problem since the wires' length is shortened when the wires are twisted.

Previously twisting machines used vertical motions or movements of the twisting head to compensate for shortening of the twisted wires. However, these machines have several deficiencies, such as a height limitation of the twisting head, e.g., a range in which it is moved up and down and a length limitation of the wire to twist. Furthermore, these machines are complex and do not provide for a balanced force of wires, while the wires are twisted.

Accordingly, a high demand pertains to provide for an improved apparatus and improved method for twisting a wire, parts of a wire or wires or several wires.

SUMMARY

It is thus an object of the present disclosure to overcome some or all of the deficiencies of the prior art. In particular, it is an object of the disclosure to provide for an improved apparatus for twisting a wire, parts of a wire or wires or several wires. It is a further object to provide an improved method for twisting a wire, parts of a wire or wires or several wires. The apparatus and method should be simplified and cost-effective.

These objects are at least partially achieved by the independent claims. Preferred aspects are subject of the dependent claims, and the skilled person finds hints for other suitable aspects of the present disclosure through the overall disclosure of the present application.

A first embodiment is directed to an apparatus for twisting an elongate element such as a wire or cable, including a) a first holder configured to hold a first portion of the element; b) a second holder configured to hold a second portion of the element; c) a twisting unit configured to twist the element at a third portion between the first and the second portion; wherein the twisting unit and the second holder are configured to be movable relative to the first holder in the same direction. The term wire as used herein is used in its broadest sense and covers all kind of wires, cables, cords, leads, etc. that are used for transmitting electrical power and/or signals.

A holder may be an arrangement than can hold, grip, or secure an element, when the element is arranged or used in the apparatus. A twisting unit may be a mechanism to twist the element. Generally, the element is not part of the apparatus, however, when the apparatus is used or is in operation to twist an element, an element is usually placed in at least a part of the apparatus. The element may be a wire, cable, a lead, a strand, or the like that may be twisted. The element may be folded prior to twisting to form two or more substantially parallel parts of the element that may be twisted about one another, and which may be cut prior or after twisting. The element may also include one or more elements that may be twisted about one another. Twisting of the element may be understood as a rotation along an elongate axis of the element. In one example, twisting of the element may include twisting two or more individual parts of the element about one another, e.g., by folding the element prior to twisting. In another example, twisting the element may include twisting two or more elements, such as two or more wires, about one another.

The twisting unit may advantageously be configured to interact with a central portion of the element when the element is arranged or used in the apparatus for twisting the element. For example, the twisting unit may be arranged substantially in the middle between the second holder and the first holder.

This apparatus is configured to twist an element and may beneficially compensate for a length reduction of a twisted element, which may occur during twisting the element. Further, the apparatus may advantageously not be limited to any vertical motions of parts included by the apparatus. The forces acting on the element may be improved during twisting due to the twisting unit and the second holder being configured to be movable relative to the first holder in the same direction. The same direction of the motion of the second holder and the twisting unit may include the same longitudinal and/or the same horizontal direction. The extent of motion of the second holder and the twisting unit in the same direction may be different to one another. In one example, the twisting unit and the second holder move towards the first holder during twisting an element to beneficially compensate for a length reduction. Thus, the twisting may be more stable. In particular, compared to vertical motions of twisting units for a length compensation of an element during twisting, as suggested in the prior art, the apparatus according to the present disclosure may facilitate a more efficient and ergonomic unloading of the element. Further, the unloading of the element may be easily automated by the apparatus. The apparatus thus beneficially allows to compensate for a length reduction during twisting the element. The twisting force, torsion and tension force of the element are improved.

Preferably, the second holder and the twisting unit of the apparatus are configured such that the motion of the second holder is synchronized with the motion of the twisting unit.

A synchronization of the motion of the second holder and the motion of the twisting unit may include that a motion of the twisting unit entails a motion of the second holder or vice versa. The motions must not necessarily be the same with respect to an amount of velocity. These motions may be in the same, preferably horizontal, and longitudinal direction. These motions may allow for compensating a length reduction during twisting.

Further preferably, in the apparatus, the motion of the second holder and the motion of the twisting unit are substantially in a translational direction, preferably substantially parallel to a longitudinal axis of the element when arranged in the apparatus.

A translational direction of motion may be understood as a motion in one axis. This motion may be easy to provide for and thus simplifies the apparatus.

In another preferred embodiment, the second holder and the twisting unit of the apparatus are configured to perform substantially horizontal motions in a direction towards the first holder and away from the first holder.

A horizontal motion may be understood as perpendicular to the gravity. Thus, the motion is not required to be against gravity, which simplifies the motion. This motion may be performed during twisting an element. Reducing a distance of the second holder and the twisting unit to the first holder by way of a direction of motion towards the first holder facilitates a length compensation of an element during twisting of the element.

Preferably, in the apparatus, the motion of the second holder and the motion of the twisting unit are coupled by a gear mechanism, defining a relationship of the motion of the second holder and the motion of the twisting unit.

A gear mechanism may include a gear with a gear ratio. The gear mechanism may have one or more stages. The gear ratio may translate a motion of the twisting unit to a motion of the second holder or vice versa.

Further preferably, in the apparatus, the second holder and the twisting unit are configured such that a translational velocity of the motion of the second holder is greater than a translational velocity of the motion of the twisting unit by a factor of 1.5 to 2.5 if L2 is greater than L1 by a factor of 1.5 to 2.5, preferably by a factor of 1.8 to 2.2 if L2 is greater than L1 by a factor of 1.8 to 2.2, wherein L2 is a distance of the second holder to the first holder and L1 is a distance of the twisting unit to the first holder.

The ratio of the translational velocity of the second holder and the twisting unit may beneficially depend on the distances L2 and L1. For example, if L2 is twice the value of L1, then the translational velocity of the second holder may be twice the value of the translational velocity of the twisting unit. In another example, if L2 is 2.1 the value of L1, then the translational velocity of the second holder may be 2.1 the value of the translational velocity of the twisting unit. This may advantageously provide for an improved length compensation during twisting an element.

Preferably, in the apparatus, the second holder and the twisting unit are configured such that a translational velocity of the second holder and a translational velocity of the twisting unit are coupled to a rotational twisting velocity of the twisting unit.

Twisting an element may include a rotation of at least part of the twisting unit included by the apparatus. This rotation may be described by a rotational twisting velocity. For example, if the rotational twisting velocity of the twisting unit is increased, a translational velocity of the second holder and a translational velocity of the twisting unit may be beneficially increased as well to allow for length compensation of an element during twisting the element. Therefore, coupling the rotational twisting velocity of the twisting unit to the translational velocity of the second holder and to the translational velocity of the twisting unit may be advantageous. A rotational twisting velocity may also be described by an angular velocity.

Further preferably, in the apparatus, the first holder is configured to hold the first portion of the element in a removably fixed manner, and the second holder is configured to hold the second portion of the element in a removably fixed manner, when the element is arranged in the apparatus.

For example, configured to hold the first or second portion may include that the element is gripped or secured, when the element is arranged or used in the apparatus. Thus, twisting of the element in proximity of the first portion and the second portion of the element may be substantially prevented. Twisting of the element in the remaining portions of the element may be facilitated.

Preferably, in the apparatus, the twisting unit is configured to interact with the element, when arranged in the apparatus, at a portion between 20% to 80%, preferably 30% to 70%, more preferably 40% to 60%, most preferably between 45% to 55% of a distance of the first holder and the second holder.

The twisting unit is preferably configured such that it interacts with an element at a central position of the element when the element is arranged in or used in the apparatus. A central position may be understood with respect to the first and the second holder, e.g., most preferably a central position may be a position at 50% of the distance of the first holder and the second holder.

Further preferably, in the apparatus, the second holder is configured to establish a tension force on the element to maintain a substantially straight alignment.

A tension force may be understood as a force that substantially provides for an elongate and horizontal shape of the element when the element is arranged or used in the apparatus for twisting the element. This may provide for a substantially straight alignment of an element, when used in the apparatus. During operation of the apparatus, a substantially small amount of sagging of the element may be allowed. This sagging may be understood as a portion of the element between the first holder and the twisting unit or between the twisting unit and the second holder may be slightly lower with respect to a horizontal line that passes through the first portion of the element, which may be hold by the first holder and the second portion of the element, which may be hold by the second holder.

Preferably, in the apparatus, the twisting unit is configured to twist the element, when arranged in the apparatus, at the third portion causing twisting substantially the overall element, when the element is arranged in the apparatus.

Another embodiment of the disclosure is directed to a method for twisting an elongate element such as a wire or cable, including: a) providing an elongate element; b) holding a first portion of the element with a first holder; c) holding a second portion of the element with a second holder; and d) twisting the element at a third portion between the first and the second portion with a twisting unit, wherein the twisting unit and the second holder are moved relative to the first holder in the same direction, preferably in the same translational direction.

Preferably, in the method, the second holder and the twisting unit are moved substantially horizontally towards the first holder while twisting the element, optionally wherein a translational velocity of the second holder and a translational velocity of the twisting unit are coupled to a rotational twisting velocity of the twisting unit while twisting the element.

Further preferably, in the method, providing the elongate element includes:

folding the element to form two or more substantially parallel parts of the element, such as two or more wires, stripes or leads, preferably before twisting the element; or providing one or more other elements to form two or more substantially parallel elements, such as two or more wires, stripes or leads preferably before twisting the one or more elements;

optionally wherein twisting the element includes:

rotating a central portion of the two or more parts of the element or rotating a central portion of the two or more elements, thereby twisting the two or more parts of the element or the two or more elements about one another.

The element provided in the method and/or used in the apparatus may be a wire, cable, a lead, a strand, or the like that may be twisted. The element may be folded prior to twisting to form two or more substantially parallel parts of the element that may be twisted about one another, and which may be cut prior or after twisting.

The element may also include one or more elements that may be twisted about one another. Twisting of the element may be understood as a rotation along an elongate axis of the element. In one example, twisting of the element may include twisting two or more individual parts of the element about one another, e.g., by folding the element prior to twisting. In another example, twisting the element may include twisting two or more elements, such as two or more wires, about one another.

The method may advantageously include steps to operate the apparatus as described above.

Another embodiment of the disclosure is directed to a twisted element manufactured according to the method described above.

The element that can be used in an apparatus and the method according to an embodiment of the disclosure may have a cross section between 0.1-20.0 $mm^2$, more preferably between 0.5-15.0 $mm^2$, even more preferably between 1.0-10.0 $mm^2$, even further preferably between 2.0-8.0 $mm^2$, most preferably between 4.0-6.0 $mm^2$.

Furthermore, the element that can be used in an apparatus and the method according to an embodiment of the disclosure may have a length before twisting between 2000

6000 mm, preferably between 2500-5000 mm, more preferably between 3000-4000 mm, most preferably between 3200-3800 mm. The element may also be deformable, for instance it may be deformable by user interaction.

BRIEF DESCRIPTION OF THE DRAWINGS

The present invention is now described, by way of example with reference to the accompanying drawings, in which.

DETAILED DESCRIPTION

In the following, non-limiting examples are described in more detail. However, the present invention is not limited to these, and a multitude of other embodiments are applicable without departing from the spirit of the invention.

Figure 1:
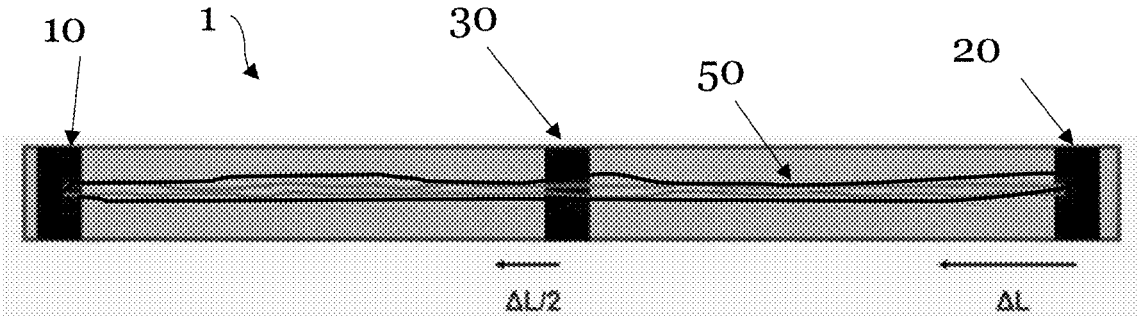
FIG. 1 illustrates a schematic view of an apparatus in a first state according to an embodiment.

FIG. 1 illustrates a schematic view of an apparatus 1 in a first state. The apparatus 1 includes a first holder 10, a second holder 20 and a twisting unit 30. In this particular embodiment, an element 50 is placed in the apparatus 1. The element 50 is generally not part of the apparatus 1. However, when the apparatus 1 is used, typically an element 50 is placed in the apparatus 1.

The element 50 may be a wire 50, for instance a single wire folded such that it forms two substantially parallel parts of the wire. In another example the wire may be folded multiple times to form multiple substantially parallel parts of the wire. The folded wire may be cut prior or after it is twisted using the apparatus 1. The element 50 may also be one or more individual wires, forming substantially parallel wires next to each other.

The first holder 10 is configured to hold a first portion of the element. The second holder 20 is configured to hold a second portion of the element 50. The holders 10, 20 can be opened for receiving a portion of the element. The holders 10, 20 can also be closed for holding and substantially fixing a portion of the element.

The twisting unit 30 is configured to twist the element at a third portion of the element. The twisting unit 30 interacts with the element between the second holder 20 and the first holder 10. For example, the twisting unit 30 interacts with the element at half a length of L2, wherein L2 is a distance of the second holder 20 to the first holder 10.

The first state of the apparatus may represent a state, which is prior to twisting the element with the twisting unit or it may be a state in proximity to start twisting the element with the twisting unit.

Figure 2:
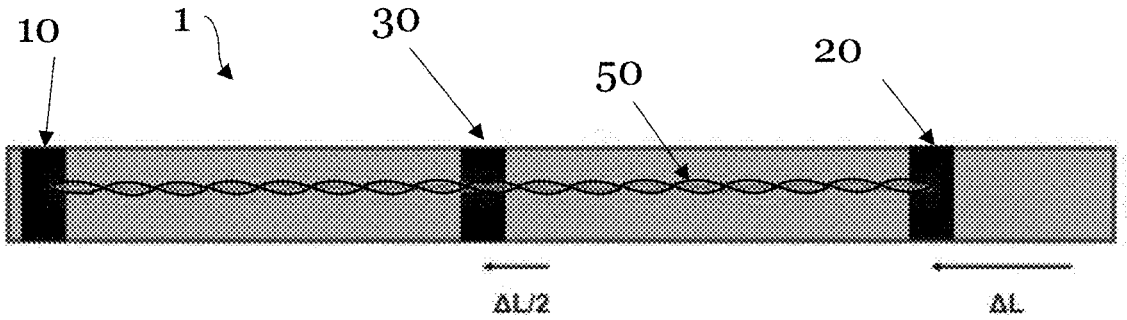
FIG. 2 illustrates a schematic view of an apparatus in a second state according to an embodiment.

FIG. 2 illustrates apparatus 1 in a second state. The second state may represent a state, which is during or after twisting the element with the twisting unit. For example, when the apparatus is operating, the second holder 20 may have a velocity, which is greater than the velocity of the twisting unit 30 by a factor of 2, wherein both, the second holder 20 and the twisting unit 30 move towards the first holder 10.

Figure 3:
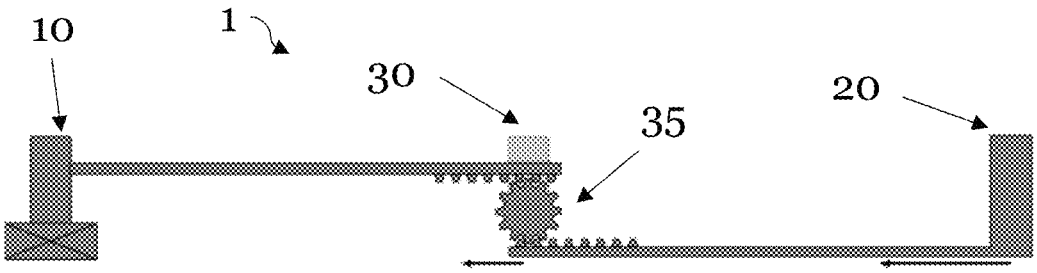
FIG. 3 illustrates a schematic view of an apparatus in a first state according to an embodiment.

FIG. 3 illustrates details of the moving mechanism of apparatus 1 in the first state. The apparatus 1 includes a gear mechanism 35. This gear mechanism provides for a relationship of the translational velocities of the twisting unit 30 and the second holder 20, when the apparatus is in use or when the apparatus is operating.

Figure 4:
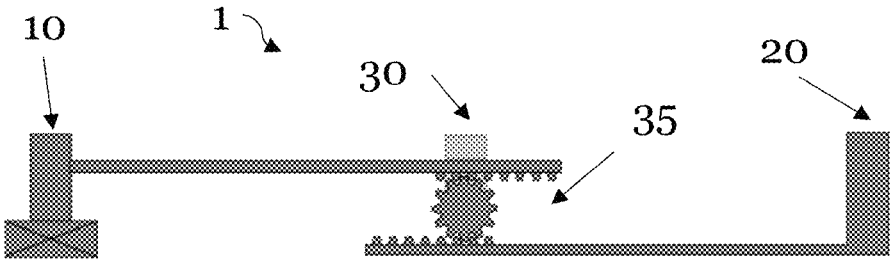
FIG. 4 illustrates a schematic view of an apparatus in a second state according to an embodiment and FIG. 5 illustrates a flow chart of a method according to an embodiment.

FIG. 4 shows the gear mechanism 35 in the second state. The second holder 20 and the twisting unit 30 have moved towards the first holder 10 in a substantially horizontally and translational direction. Twisting the element is provided by means of a rotational twisting velocity of the twisting unit. The substantially horizontal and translational motions of the second holder 20 and the twisting unit 30 are coupled to the rotational twisting velocity of the twisting unit 30. For instance, if the apparatus is in operation and the rotational twisting velocity is increased, the translational motions of the second holder 20 and the twisting unit 30 may also be increased.

This apparatus allows to twist an element or one or more elements, wherein the apparatus is not limited to length restrictions of the element. This generally allows to twist elements with a high length. Further, the apparatus is not limited to any vertical motions of parts included by the apparatus. The forces acting on the element are improved during twisting; thus, the twisting is more stable. In particular, compared to vertical motions of twisting units for a length compensation of an element during twisting, as suggested in the prior art, the apparatus described herein allows for a more efficient and ergonomic unloading of the element. Further, the unloading of the element can be easily automated. The apparatus thus beneficially allows to compensate for a length reduction during twisting the element. The apparatus may be applied for twisting of several wires or lead types, e.g., speakers and CAN/CAN FD applications. The advantages of the apparatus may equally apply to the method as described herein.

Figure 5:
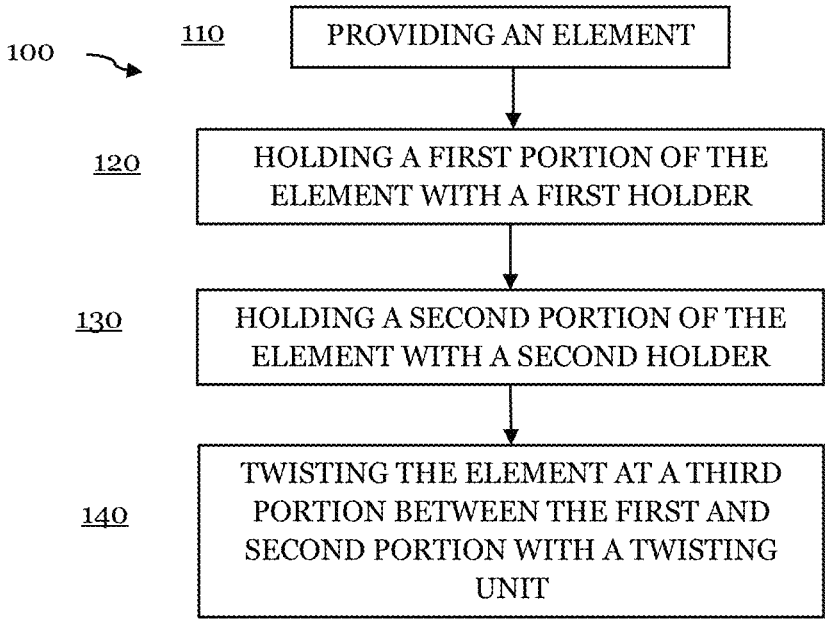

FIG. 5 illustrates a flow chart of a method 100, according to an embodiment. The method 100 includes the step of providing 110 an element. The method 100 further includes the step of holding 120 a first portion of the element with a first holder. Moreover, the method 100 includes the step of holding 130 a second portion of the element with a second holder. The method also includes the step of twisting 140 the element at a third portion between the first and the second portion with a twisting unit. During twisting, the twisting unit and the second holder are moved relative to the first holder in the same direction, preferably in a same translational direction.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses all possible combinations of one or more of the associated listed items. It will be further understood that the terms "includes," "including," "includes," and/or "including," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any order of arrangement, order of operations, direction or orientation unless stated otherwise.

The invention claimed is:

1. An apparatus for twisting an elongate element, comprising:

a first holder configured to hold a first portion of the elongate element;

a second holder configured to hold a second portion of the elongate element; and a twisting unit configured to twist the element at a third portion between the first and the second portion, wherein the twisting unit and the second holder are configured to be movable relative to the first holder in a same direction, wherein a motion of the second holder and a motion of the twisting unit are coupled by a gear mechanism, thereby defining a relationship of the motion of the second holder and the motion of the twisting unit, and wherein the second holder and the twisting unit are configured such that a translational velocity of a motion of the second holder is greater than a translational velocity of the motion of the twisting unit.

2. The apparatus according to claim 1, wherein the second holder and the twisting unit are configured such that a motion of the second holder is synchronized with the motion of the twisting unit.

3. The apparatus according to claim 1, wherein a motion of the second holder and a motion of the twisting unit are substantially in a translational direction.

4. The apparatus according to claim 1, wherein the second holder and the twisting unit are configured to perform substantially horizontal motions in a direction towards the first holder and away from the first holder.

5. The apparatus according to claim 1, wherein the second holder and the twisting unit are configured such that the translational velocity of a motion of the second holder is greater than the translational velocity of the motion of the twisting unit by a factor of 1.5 to 2.5 when a distance of the second holder to the first holder is greater than a distance of the twisting unit to the first holder by a factor of 1.5 to 2.5.

6. The apparatus according to claim 1, wherein the second holder and the twisting unit are configured such that a translational velocity of the second holder and a translational velocity of the twisting unit are coupled to a rotational twisting velocity of the twisting unit.

7. The apparatus according to claim 1, wherein the first holder is configured to hold the first portion of the element in a removably fixed manner, and the second holder is configured to hold the second portion of the element in a removably fixed manner, when the element is arranged in the apparatus.

8. The apparatus according to claim 1, wherein the twisting unit is configured to interact with the element, when arranged in the apparatus, at a portion between 20% to 80% of a distance of the first holder and the second holder.

9. The apparatus according to claim 1, wherein the second holder is configured to establish a tension force on the element to maintain a substantially straight alignment when arranged in the apparatus.

10. The apparatus according to claim 1, wherein the twisting unit is configured to twist the element at the third portion substantially causing twisting of the element when the element is arranged in the apparatus.

11. A method for twisting an elongate element, comprising:

a) providing an elongate element;

b) holding a first portion of the element with a first holder;

c) holding a second portion of the element with a second holder; and d) twisting the element at a third portion between the first and the second portion with a twisting unit, wherein the twisting unit and the second holder are moved relative to the first holder in a same direction, wherein a motion of the second holder and a motion of the twisting unit are coupled by a gear mechanism, thereby defining a relationship of the motion of the second holder and the motion of the twisting unit, and wherein the second holder and the twisting unit are configured such that a translational velocity of a motion of the second holder is greater than a translational velocity of the motion of the twisting unit.

12. The method according to claim 11, wherein the second holder and the twisting unit are moved substantially horizontally towards the first holder while twisting the element.

13. The method according to claim 12, wherein a translational velocity of the second holder and a translational velocity of the twisting unit are coupled to a rotational twisting velocity of the twisting unit while twisting the element.

14. The method according to claim 11, wherein the step of providing the elongate element comprises:

folding the element to form two or more substantially parallel parts of the element.

15. The method according to claim 14, wherein the step of twisting the element comprises:

rotating a central portion of the two or more parts of the element or rotating a central portion of the two or more substantially parallel parts of the element, thereby twisting the two or more substantially parallel parts of the element about one another.

16. The method according to claim 11, wherein the step of providing the elongate element comprises:

providing one or more other elements to form two or more substantially parallel elements.

* * * * *